United States Patent [19]

Klynas

[11] 4,418,598

[45] Dec. 6, 1983

[54] ELECTRONIC PERCUSSION SYNTHESIZER

[75] Inventor: Scott S. Klynas, Simi Valley, Calif.

[73] Assignee: Mattel, Inc., Hawthorne, Calif.

[21] Appl. No.: 335,985

[22] Filed: Dec. 30, 1981

[51] Int. Cl.[3] ..... G10H 1/40; G10H 3/12

[52] U.S. Cl. ..... 84/1.03; 84/1.04; 84/1.06; 84/1.1; 84/484; 84/DIG. 12

[58] Field of Search ..... 84/1.03, 1.04, 1.06, 84/1.09, 1.1, 1.14, 1.27, DIG. 12, 477 R, 484

[56] References Cited

U.S. PATENT DOCUMENTS

| | | | |
|---|---|---|---|
| 3,439,568 | 4/1969 | Griffith | 84/DIG. 12 |
| 3,551,580 | 12/1970 | Glenn | 84/DIG. 12 |
| 3,553,339 | 1/1971 | Dominguez | 84/DIG. 12 |
| 3,915,047 | 10/1975 | Davis et al. | 84/1.03 |
| 3,956,959 | 5/1976 | Ebihara et al. | 84/DIG. 12 |
| 4,080,863 | 3/1978 | Groeschel | 84/1.27 |
| 4,226,156 | 10/1980 | Hyakutake | 84/DIG. 12 |
| 4,309,932 | 1/1982 | Baker | 84/1.03 |
| 4,350,070 | 9/1982 | Bahu | 84/1.03 |
| 4,357,854 | 11/1982 | Hirano | 84/1.03 |

*Primary Examiner*—S. J. Witkowski
*Attorney, Agent, or Firm*—Reagin & King

[57] ABSTRACT

An electronic percussion synthesizer is disclosed which includes a plurality of pressure transducers, each representing a different percussive musical instrument. Each transducer is responsive to an external striking force for generating analog pulses, each pulse representing one beat of the respective musical instrument. The transducers are mounted to a synthesizer housing in a manner which mechanically isolates the transducers from each other. Sound signal generating circuits are provided which are responsive to the analog pulses for generating sound signals comprising the beat of the respective musical instrument. The amplitude of the signal representing each beat is proportional to the magnitude of the force used to generate the respective analog pulse. The synthesizer also includes storage and playback circuitry for digitally storing a series of pulses, each pulse representing a percussive beat; for playing back the stored pulses; and for storing additional pulses in an interleaving manner.

11 Claims, 10 Drawing Figures

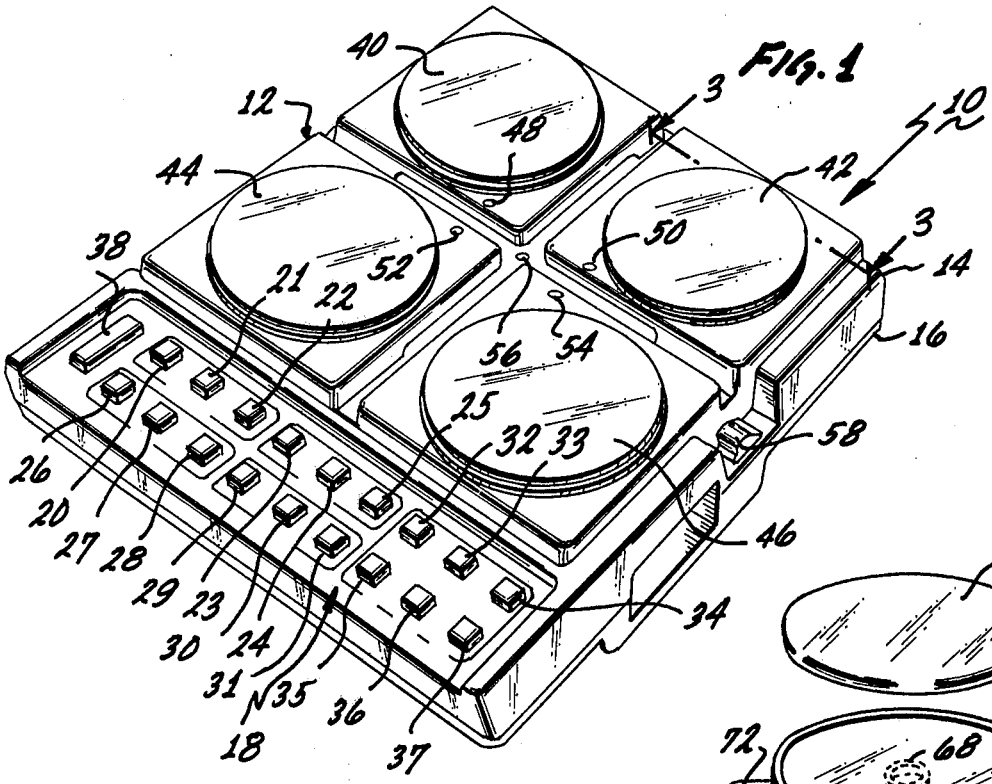
Fig. 1
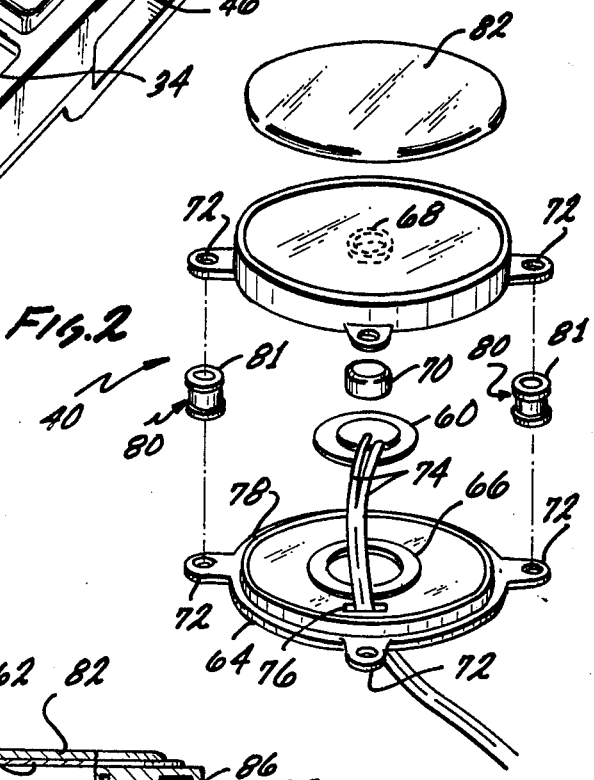
Fig. 2
Fig. 3
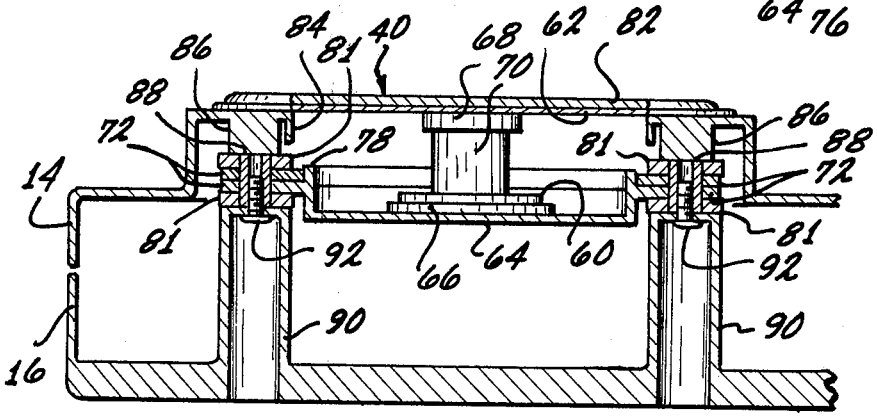

FROM STEP 320 OF FIG. 7

330
ANY DRUM KEYS PRESSED ?
N
Y
335
STORE RESPECTIVE KEY CLOSURES
340
ACCENT KEY PRESSED ?
N
Y
345
STORE ACCENT KEY CLOSURE
BASS DRUM KEY PRESSED ?
N
Y
355
REVERSE BASS DRUM STATUS
360
CLOCK PULSE ?
N
GO TO STEP 250 OF FIG. 7
Y
365
SIXTEENTH CLOCK PULSE
N
Y
370
PROVIDE BASS DRUM PULSE
375
FLASH BASS DRUM LED
INTERROGATE KEYS
380
385
GENERATE RHYTHM AND ACCENT PULSES
TO STEP 390 OF FIG. 9

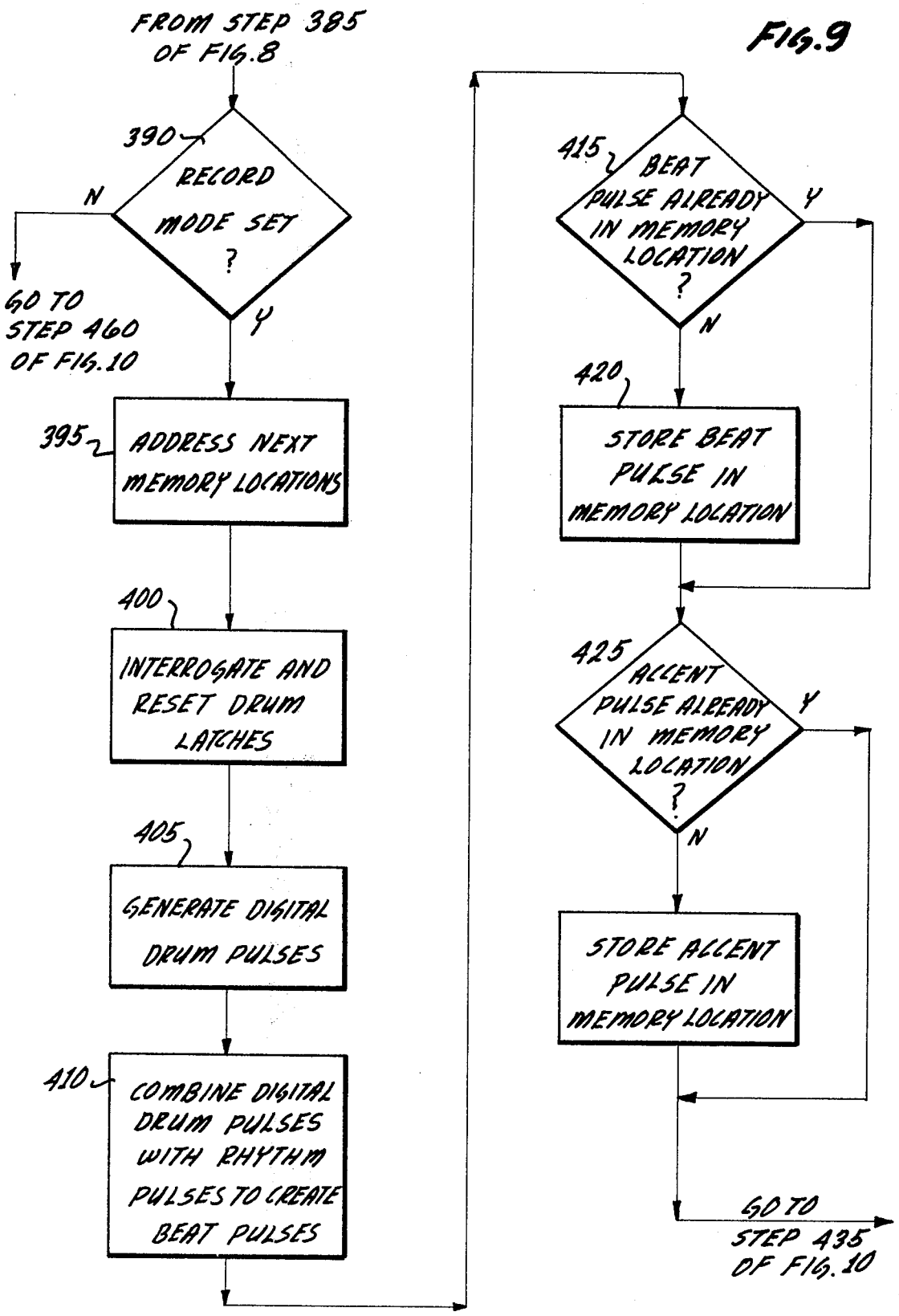
FROM STEP 385 OF FIG.8
FIG.9
390
RECORD MODE SET ?
N
Y
GO TO STEP 460 OF FIG.10
395
ADDRESS NEXT MEMORY LOCATIONS
400
INTERROGATE AND RESET DRUM LATCHES
405
GENERATE DIGITAL DRUM PULSES
410
COMBINE DIGITAL DRUM PULSES WITH RHYTHM PULSES TO CREATE BEAT PULSES
415
BEAT PULSE ALREADY IN MEMORY LOCATION ?
Y
N
420
STORE BEAT PULSE IN MEMORY LOCATION
425
ACCENT PULSE ALREADY IN MEMORY LOCATION ?
Y
N
STORE ACCENT PULSE IN MEMORY LOCATION
GO TO STEP 435 OF FIG.10

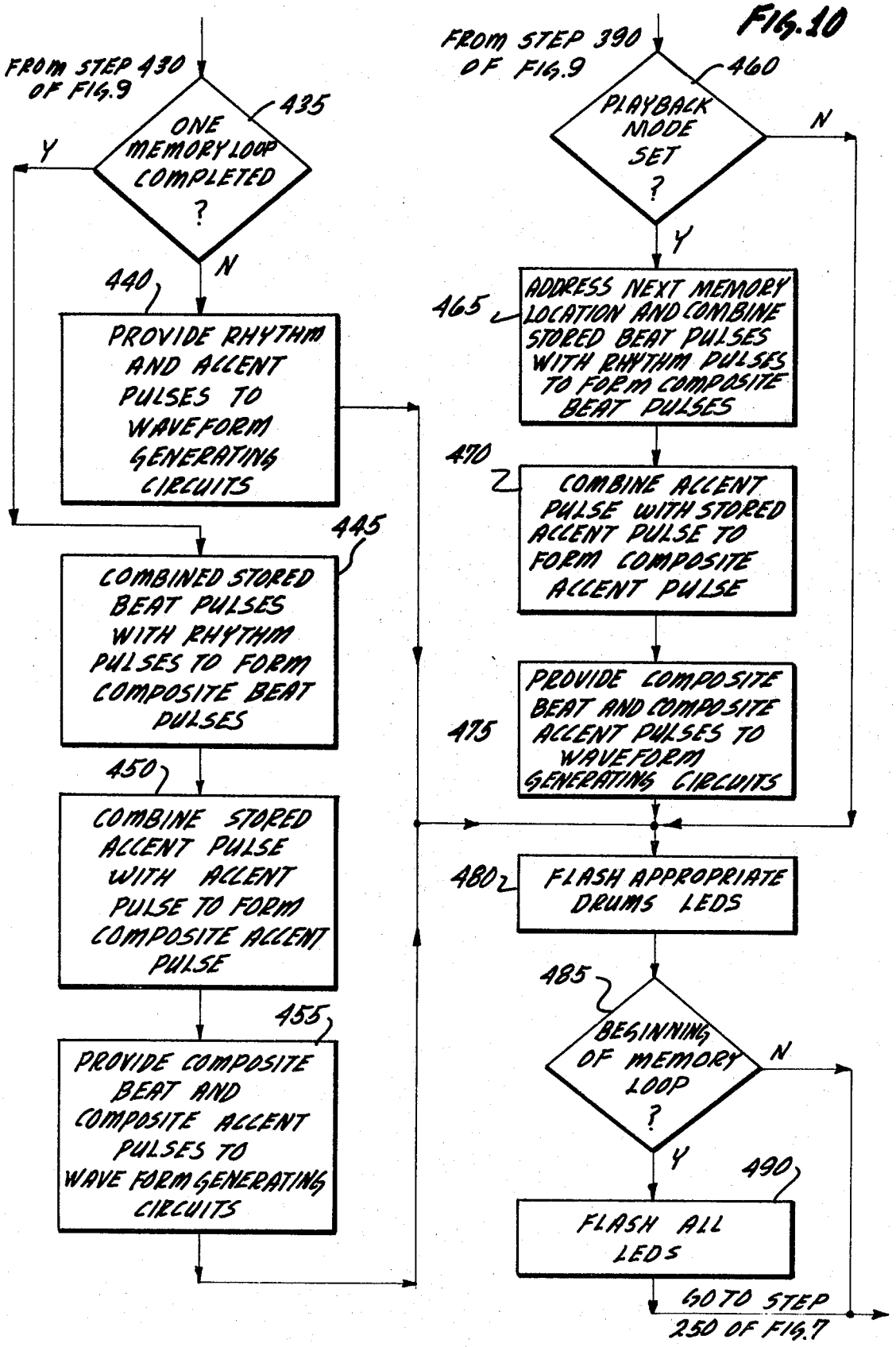
FIG. 10
FROM STEP 430 OF FIG. 9
ONE MEMORY LOOP COMPLETED ?
435
Y
N
440
PROVIDE RHYTHM AND ACCENT PULSES TO WAVEFORM GENERATING CIRCUITS
445
COMBINED STORED BEAT PULSES WITH RHYTHM PULSES TO FORM COMPOSITE BEAT PULSES
450
COMBINE STORED ACCENT PULSE WITH ACCENT PULSE TO FORM COMPOSITE ACCENT PULSE
455
PROVIDE COMPOSITE BEAT AND COMPOSITE ACCENT PULSES TO WAVE FORM GENERATING CIRCUITS
FROM STEP 390 OF FIG. 9
PLAYBACK MODE SET ?
460
N
Y
465
ADDRESS NEXT MEMORY LOCATION AND COMBINE STORED BEAT PULSES WITH RHYTHM PULSES TO FORM COMPOSITE BEAT PULSES
470
COMBINE ACCENT PULSE WITH STORED ACCENT PULSE TO FORM COMPOSITE ACCENT PULSE
475
PROVIDE COMPOSITE BEAT AND COMPOSITE ACCENT PULSES TO WAVEFORM GENERATING CIRCUITS
480
FLASH APPROPRIATE DRUMS LEDS
485
BEGINNING OF MEMORY LOOP ?
N
Y
490
FLASH ALL LEDS
GO TO STEP 250 OF FIG. 7

ELECTRONIC PERCUSSION SYNTHESIZER

BACKGROUND OF THE INVENTION

This invention relates to music synthesizers, and more particularly to an electronic music synthesizer capable of synthesizing the sounds of percussion instruments.

Over the years, many electronic music instruments have been developed which generate sound entirely by electronic means. These devices, generally categorized as music synthesizers, generate electronic signals which are shaped and blended together to create different types of waveforms which can be amplified and played through conventional speakers to create different types of sounds.

Many of these prior art music synthesizers employ a keyboard for entering the musical notes to be synthesized. A variety of controls may also be provided to cause the synthesizer to play predetermined rhythm patterns. Generally, the musical notes entered using the keyboard produce sounds simulating a keyboard controlled musical instruments such as a piano or an organ. The predetermined rhythm patterns, on the other hand, may be designed to produce sounds simulating percussion musical instruments such as drums. The tempo of the synthesized music is usually established by playing one of the predetermined rhythm patterns as background music and by adjusting the speed of the rhythm pattern using a tempo control. The user then plays the keyboard notes in time to the preset rhythm tempo. The musical notes and rhythm patterns are usually all played at the same aplitude which is adjusted using a volume control. A typical musical synthesizer of the type described above is disclosed in U.S. Pat. No. 4,226,155, issued Oct. 7, 1980, and assigned to the assignee of the present invention.

In recent years, music synthesizers have been developed which are capable of recording the musical notes played. The user may then play back the recorded notes in the form of a tune. To record a new tune, it is generally necessary to erase the tune previously recorded.

Because of the manner in which percussion instruments (such as drums and cymbals) are played, many prior art music synthesizers do not accurately synthesize such instruments. For example, a musician generally develops percussion rhythms one beat at a time and then interleaves several of these rhythms together to produce musical phrases. The beat of one of these rhythms is usually used to establish the tempo of the succeeding rhythms. The musician may also alter the amplitude of each percussion beat. The amplitude of each beat is generally controlled by the amount of force used to strike the instrument surface. The ability to alter the amplitude of each beat enables the musician to enhance the tonal quality of the music.

Generally, prior art synthesizers capable of recording musical notes cannot be used to develop percussion rhythms in the same manner as they are developed using a conventional percussion instrument. This is so because these prior art synthesizers generally do not include a surface which may be struck in the manner of a percussion instrument to produce a percussion beat. Many prior art synthesizers are only capable of recording one rhythm at a time, so they cannot be used to interleave a plurality of previously developed rhythms with newly developed rhythms. Further, prior art synthesizers generally do not have the ability to vary the amplitude of individual percussion beats.

It is accordingly an object of the present invention to prove a new and improved electronic percussion synthesizer.

It is another object of the present invention to produce percussion beats in the same manner as they are produced using a conventional percussion instrument and to enable these beats to be recorded.

It is yet another object of the present invention to store multiple percussion rhythms in a manner which permits these rhythms to be interleaved with each other.

It is yet another object of the present invention to create a tempo from a series of percussion beats and to use this tempo to establish the tempo of succeeding percussion synthesizers.

SUMMARY OF THE INVENTION

Briefly stated and in accordance with the presently preferred embodiment of the invention, the foregoing and other objects are accomplished by providing an electronic percussion synthesizer which includes a plurality of pressure transducers each mounted within a drum housing having a striking surface designed to represent the striking surface of a percussion instrument. Each transducer is responsive to an external striking force for generating an analog drum signal comprising analog drum pulses each representing one beat of the respective musical instrument. The amplitude of each pulse is proportional to the magnitude of the striking force.

The individual drum housings are mounted to a common synthesizer housing in a manner which mechanically isolates each transducer from the other transducers so that the force striking one transducer does not cause any of the other transducers to produce a pulse.

Sound generating circuits are provided which are responsive to the analog pulses for generating sounds comprising the beat of the respective musical instrument. The amplitude of the sound generated is proportional to the amplitude of the respective analog pulse.

The synthesizer of the present invention also includes storage and playback circuitry for digitally storing a series of pulses, each pulse representing a percussion beat; for playing back the stored pulses; and for storing additional pulses in an interleaving manner. The storage and playback circuitry includes a digital memory having sequentially addressable memory locations, a tempo control circuit for establishing a clock rate at which the memory locations are addressed, and latch circuits responsive to the respective analog drum signals for latching into a first state in response to the occurrence of an analog drum pulse.

A computer circuit, responsive to the tempo control circuit and the latch circuit, interrogates and resets the latch at the clock rate established by the tempo control circuit. The computer circuit also sequentially addresses the memory locations in a recirculating loop at this same clock rate. The computer circuit generates a beat signal in the form of a beat pulse if the latch is in the first state when it is interrogated, and stores the beat pulse in the addressed memory location if that location does not already contain the beat pulse.

The sound generating circuits are responsive to the computer circuit and generate a sound comprising the beat of the respective musical instrument if the memory location addressed contains the beat pulse.

Other objects, features and advantages of the invention will become apparent from a reading of the specification taken in conjunction with the drawings in which like reference numerals refer to like elements in the several views.

BRIEF DESCRIPTION OF THE DRAWINGS

FIG. 1 is a perspective view of the electronic percussion synthesizer constructed in accordance with the present invention;

FIG. 2 is an exploded perspective view of one of the drums of the synthesizer;

FIG. 3 is a cross-sectional view of the synthesizer taken along the line 3—3 of FIG. 1 to show how the drum of FIG. 2 is mounted to the synthesizer housing;

FIGS. 7 through 10 are flow charts showing the program and operation of the preferred embodiment of the synthesizer of the present invention.

DESCRIPTION OF THE PREFERRED EMBODIMENT

Figure 4:
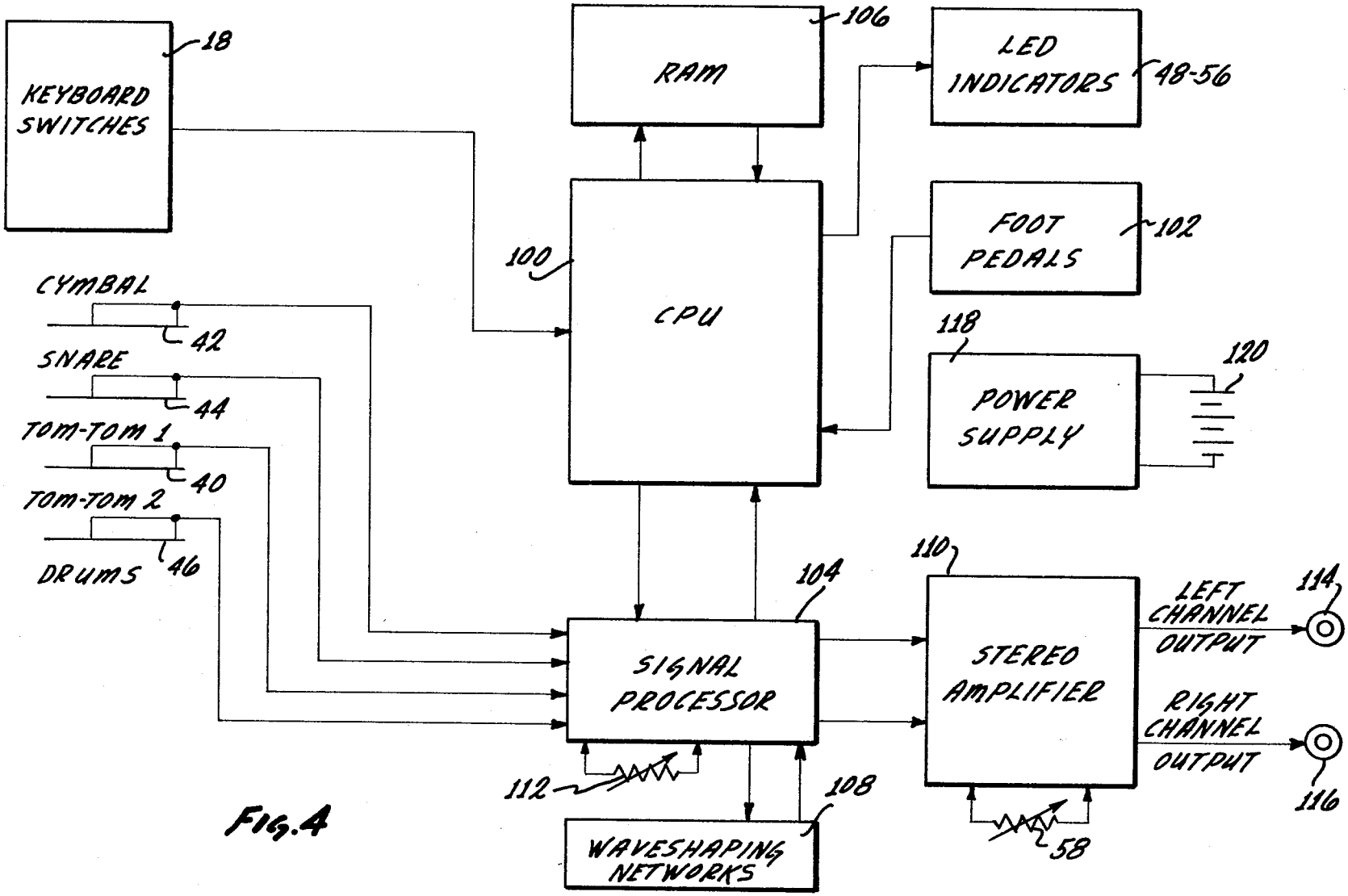
FIG. 4 is an overall block diagram of the electronic portion of the synthesizer of FIG. 1.

FIG. 1 shows a perspective view of an electronic percussion synthesizer 10 constructed in accordance with the present invention. The synthesizer 10 includes a housing 12 having an upper section 14 and a lower section 16. A keyboard 18 is mounted to the housing 12 and includes nineteen keys 20–38. Four drums 40, 42, 44 and 46 are provided which are mounted through openings in the upper section 14 of the housing 12. The drum 40 is designated as a first Tom-Tom drum; the drum 42 as a cymbal; the drum 44 as a snare drum; and the drum 46 as a second Tom-Tom drum having a lower pitch then the first Tom-Tom drum. Striking the surface of one of the drums 40–46 causes the synthesizer 10 to immediately generate a sound representing one beat of the designated percussion instrument. It is a feature of the synthesizer 10 that the harder the drums 40–46 are struck, the greater the amplitude of the sounds generated by the synthesizer 10. The drums 40–46 may be played using hands or conventional drum sticks, and may be played alone or in combination with the keys 20–38 of the keyboard 18 to produce a wide range of percussion sounds.

The synthesizer 10 produces sounds be generating two channels of electrical signals representative of those sounds. These signals are provided to an electrical connector (not shown) mounted to the housing 12. The user may connect stereo headphones or a stereo sound system to this connector to provide audible signals. A volume control 58 is provided to adjust the amplitude of the signals provided to the connector. A tuning control (not shown) is also provided to adjust the pitch of the first Tom-Tom drum. A second connector (not shown) is also provided for connecting foot pedals which may be used to control several of the functions of the synthesizer 10.

The electronic circuitry within the synthesizer 10 is powered by batteries which are inserted into a battery compartment (not shown) within the housing 12. Five visual indicators in the form of light emitting diodes (LEDs) 48, 50, 52, 54 and 56 are mounted through the upper section 14 of the housing 12. One of the four LEDs 48–54 is positioned adjacent each of the respective drums 40–46 and is caused to flash whenever the synthesizer 10 generates a beat representative of the sound of that respective drum. The function of the fifth and centrally located LED 56 is described below.

The function of each of the keys 20–38 of the keyboard 18 will now be described. The keys 20–31 are used to cause the synthesizer 10 to generate beat patterns which simulate the sounds of the four percussion instruments represented by the four drums 40–46. The three keys 20–22 are grouped in an area of the keyboard 18 labeled Tom-Tom 1; the three keys 23–25, in an area labeled cymbal and memory; the three keys 26–28, in an area labeled snare; and the three keys 29–31, in an area labeled Tom-Tom 2.

Each of the three keys 20, 21 and 22 is used to initiate rhythm sounds of the first Tom-Tom drum. Pressing the key 20 initiates a series of evenly spaced drum beats at a slow rate; pressing the key 21 initiates a medium rate; and pressing the key 22 initiates a fast rate. The selected series of beats is generated as long as the respective key is pressed. A single drum beat can be initiated by quickly tapping one of the keys, such as the key 20. The keys 20, 21 and 22 may also be used in combination with each other to cause the synthesizer 10 to generate a variety of other predetermined rhythm patterns. For example, pressing simultaneously the keys 20 and 21 initiates a "rock" rhythm pattern; pressing simultaneously the keys 21 and 22 initiates a "waltz" rhythm pattern; pressing simultaneously the keys 20 and 22 initiates an "offbeat" rhythm pattern; and pressing simultaneously all three of the keys 20, 21 and 22 produces a "shuffle" rhythm pattern.

The three keys 23, 24 and 25 in the area designated cymbal perform the same functions as the respective keys 20, 21 and 22 described above except the sounds produced are those of the cymbal. In like manner, the keys 26, 27 and 28 in the area designated snare perform the same functions as the keys 20, 21 and 22 except the sounds produced are those of the snare drum. Further, the keys 29, 30 and 31 in the area designated Tom-Tom 2 perform the same functions as the keys 20, 21 and 22 except the sounds produced are that of the second Tom-Tom drum.

The key 38 of the keyboard 18 is designated "accent". Pressing the key 38 acts to change the sound of the cymbal from that of an open cymbal to that of a closed cymbal. Releasing the key 38 returns the sound to that of an open cymbal. A foot pedal may be connected to the synthesizer 10 to enable the user to control the cymbal accent using his foot, which is the way in which the accent of a conventional "hi hat" cymbal is controlled.

The keys 35, 36 and 37 of the keyboard 18 are used to control the tempo of the musical notes generated by the synthesizer 10. The key 35 is designated "slower"; the key 36 is designated "faster"; and the key 37 is designated "bass drum". The key 37 is used to initiate a continuous series of equally spaced bass drum beat sounds. The rate of the base drum beats is designated as the tempo and is used to control the rate of the beats and rhythm patterns initiated by the keys 20–31. For example, the slow series of drum beats initiated by the keys 20, 23, 26 and 29 as described above is regulated by the tempo to produce the slow series of beats at a rate of two beats for each of the bass drum beats. In like manner, the medium series of drum beats initiated by the keys 21, 24, 27 and 30 are each regulated at a rate of four beats for each of the bass drum beats; and the fast series initiated by the keys 22, 25, 28 and 31 are each regulated at a rate of eight beats for each of the bass drum beats. Accordingly, setting the tempo of the bass drum automatically sets the tempo of all of the beat patterns initiated by the keys 20–31. The tempo is also used to establish the rate at which the synthesizer records and plays back musical notes, as described in detail below.

The tempo of the bass drum may be set in several ways. Pressing the key 37 initiates the bass drum beat sound, and initially sets the bass drum beat rate to about one hundred beats per minute. This rate may be decreased or increased by pressing, respectively, the key 35 or the key 36. For example, as long as the key 36 is pressed, the rate of the bass drum beats will progressively increase to a maximum of 300 beats per minute. When the rate reaches the desired rate, releasing the key 36 will cause the synthesizer to store and hold that rate. In like manner, the key 35 may be used to decrease the rate to a lower tempo. Each time the bass drum beat is generated, the LED 56 is caused to flash, and may be used as a visual metronome.

The user may set the tempo of the synthesizer in another way, as follows. Musicians are fond of establishing a tempo for their music by tapping out a series of beats using their hand or foot. The synthesizer 10 includes a feature which enables the user to tap out a series of bass drum beats using, simultaneously, the keys 35 and 36. Circuitry within the synthesizer 10 is used to calculate the rate of the tapped beats and to automatically set and hold the bass drum tempo to the rate of occurrence of the last two beats tapped out. A foot pedal may also be connected to the synthesizer 10, the function of which is to allow the user to duplicate the hand function of pressing, simultaneously, the keys 35 and 36, by using his foot to tap the foot switch. In this way, the user may tap out a tempo with his foot which is automatically used to set the tempo of the synthesizer 10.

The bass drum sound may be turned off by again pressing the key 37. However, although the sound will not be heard, the synthesizer 10 will continue to use the last established tempo to control the synthesizer functions described above.

The synthesizer 10 includes a digital microprocessor circuit, discussed in detail below. One of the functions of this circuit is to generate evenly spaced apart clock pulses at a clock rate which is synchronized to the tempo. In a preferred embodiment of the invention, the clock is set sixteen times faster than the tempo. Accordingly, sixteen clock pulses are generated between successive beats of the bass drum. The clock pulses are used to time when the synthesizer 10 will generate a musical sound in response to actuation of the keys 20–31. Unlike striking the drums 40–46, which causes the synthesizer 10 to immediately produce a respective musical beat in response to an analog drum signal generated when the drum is struck pressing the keys 20–31 causes the synthesizer 10 to produce a musical sound only at the occurrence of a clock pulse. For example, if a key 20–31 is pressed prior to a clock pulse being generated, the synthesizer 10 will wait until the next clock pulse before the respective sound is generated. In this way, all of the sounds generated in response to the actuation of the keys 20–31 are automatically synchronized to the tempo of the bass drum.

The synthesizer 10 generates percussion rhythms in response to actuation of the keys 20–31 in the following manner. As each clock pulse is generated, the circuitry within the synthesizer 10 determines if any of the keys 20–31 have been pressed or if any of the drums 40–46 have been struck. If any of these events have occurred, the circuitry generates a respective signal in the form of digital pulses. If the signal generated is in response to the actuation of the keys 20–31, this signal (hereinafter referred to as the rhythm signal) comprising a series of rhythm pulses used to generate the appropriate musical rhythm. If the signal generated is in response to the striking of the drums 40–46 (hereinafter referred to as the digital drum signal), this signal comprises a single digital drum pulse, and no sound is generated. This is so because sounds generated by the synthesizer 10 in response to striking of the drums 40–46 are directly initiated by the analog drum pulses produced as each drum 40–46 is struck. The digital drum signal is used, however, when the synthesizer 10 is performing the recording function as described below.

In summary, the synthesizer 10 generates musical sounds in response both to an analog drum pulse produced by striking the drums 40–46 and to a rhythm signal initiated in response to the actuation of the keys 20–31. The analog drum pulses are produced whenever the drums 40–46 are struck, and the rhythm and digital drum pulses are produced in synchronism with the clock pulses.

Returning to FIG. 1, the remaining keys 32, 33 and 34 of the keyboard 18 are designated, respectively, "stop", "record" and "playback". The keys 32, 33 and 34 are used to control the recording and playback functions of the synthesizer 10. The key 33 acts to initiate the storage of signals representing the various musical notes generated by the synthesizer 10; the key 34 is used to initiate the playback of the musical notes; and the key 32 is used to stop both the record and playback functions.

The recording function of the synthesizer 10 is accomplished by storing digital signals in a semiconductor memory. The digital signals thus stored represent the actuation of the various keys 20–31 and 38 used to initiate the musical sounds generated by the synthesizer 10. The recording function of the synthesizer 10 is also capable of storing digital signals representing each strike of the drums 40–46.

The synthesizer 10 includes three separate memories which may be used to store the digital signals representing the musical notes to be generated. The keys 23, 24 and 25 are used to select which of the three memories are to be used for recording and for playback. The initiation of the recording function, as well as the selection of the memory to be used for recording are both accomplished by pressing simultaneously the record key 33 and either the key 23, 24 or 25, depending on whether the first, second or third memory is to be used for recording. In like manner, the playback key 34 is simultaneously pressed with one of the keys 23, 24 or 25 to both initiate the playback function and to select which of the three memories are to be used for playback. The LEDs 52, 54 and 56 are selectively illuminated during the memory selection process to indicate to the user which of the three memories is being selected. The LED 52 represents the first memory; the LED 56 represents the second memory; and the LED 54 represents the third memory.

The recording function of the synthesizer 10 enables the user to record multiple rhythm patterns in a manner which permits the individual patterns to be interleaved with each other. This is accomplished as follows. Each of the memories used for recording include a plurality of sequentially addressable memory locations. The circuitry within the synthesizer 10 is designed to address sequentially the locations of the memory in a recirculating loop. Thus the circuitry sequentially addresses the locations from the first location to the last location and then returns to the first location to repeat the process. This looping process is continued until the recording function is terminated by pressing the stop key 32.

The rate at which the memory locations are sequentially addressed is the clock rate described above. Thus, sixteen memory locations are sequentially addressed during the time between successive bass drum beats. A total of two hundred fixty six memory locations are provided for each memory loop. Accordingly, the loop is recirculated for every sixteen beats of the bass drum. It has been found that this memory loop length is sufficient to store a musical phrase typical of the phrases created using percussion instruments. Each of the three memories available for recording include sufficient memory locations to store signals representing rhythms of each of the four percussion instruments as well as to store signals representing the actuations of the accent key 38.

When the recording function is initiated as described above, the particular memory selected is cleared by clearing all data stored in each of the memory locations. Beginning with the first location, the circuitry sequentially addresses each memory location in response to the clock pulses generated at the clock rate.

As each memory location is addressed, the circuitry determines if either a digital drum pulse or a rhythm pulse has been generated. As described above, these pulses are generated in synchronize with the clock pulses. If either of these pulses has been generated, a digital pulse (hereinafter referred to as a beat pulse) is stored in the memory location being addressed, but only if that location does not already contain a beat pulse.

Since all of the locations in the memory have been cleared initially, the first time the circuitry loops through the memory it will not encounter any stored beat pulses. Accordingly, all of the beat pulses generated will be stored. It should be noted that during the recording process the synthesizer continues to generate musical sounds in response to the analog drum and rhythm pulses.

When the circuitry has completed the first loop through the memory, the beat pulses stored therein represent the individual percussion beats produced by the user using the drums 40–46 and the keys 20–31. For subsequent loops through the memory, the synthesizer 10 automatically generates (or plays back) the sounds represented by the stored beat pulses, with each sound being generated as each memory location is addressed. Since each location is addressed at the clock rate, the sounds are played back in synchronism with the tempo established by the keys 35 and 36.

At the same time as the synthesizer is generating sounds in response to the stored beat pulses, it also continues to generate new sounds in response to further striking of the drums 40–46 and actuation of the keys 20–31. In addition, the synthesizer 10 continues to store the beat pulses representing these new sounds.

As noted above, beat pulses can only be stored in memory locations not previously containing the beat pulse. Accordingly, the synthesizer 10 will only store newly created beat pulses in those memory locations which are still unoccupied. This has the effect of interleaving the musical beats of one rhythm with the musical beats of previous rhythms. Thus, each time the synthesizer 10 loops through the memory locations it both plays back the previously recorded rhythms and continues to record new rhythms having beats which fall between the beats of the previous rhythms. The user may continue to play and record additional rhythms until all of the locations in the memory are filled with beat pulses. The user may then record additional rhythms by selecting another of the three memories to be used for recording.

When all of the desired rhythms have been stored, the recording process may be stopped by pressing the stop key 32. Pressing the playback key 34 in conjunction with one of the memory select keys 23–25 causes the synthesizer 10 to playback the recorded rhythms. The user may now play along with the stored rhythms by striking the drums 40–46 or pressing the keys 20–31. However, none of these new rhythms will be recorded when the synthesizer is performing the playback function.

The playback function causes the synthesizer 10 to repetitively loop through the memory locations of the selected memory and to repetitively generate the musical beats represented by each of the stored beat pulses. The rate at which the memory locations are addressed is the clock rate. Th user may alter the tempo at which the rhythms are played back by altering the rate of the bass drum beats using the keys 35 and 36 as described above. Thus the rhythms may be played back at a tempo different from the tempo at which they were recorded.

To assist the user in determining when the synthesizer has completed a memory loop, all of the LEDs 48–56 are caused to flash simultaneously each time the first memory location in the loop is being addressed. The LEDs 48–56 are flashed in this manner both in the playback and recording modes and enable the user to time the beginning of a rhythm with the beginning of the loop.

The synthesizer 10 also has the capability to store signals representing the actuation of the accent key 38 (or the actuation of the foot pedal used to control the accent). While in the recording mode, the synthesizer 10 acts to generate a signal (hereinafter referred to as an accent signal) comprising accent pulses. An accent pulse is generated in synchronism with a clock pulse if it is determined that the accent key 38 is pressed. The accent pulse is stored in a designated memory loop in a manner analogous to the storage of the beat pulse. Thus, the accent pulse will be stored in the memory location being addressed if that location does not already contain an accent pulse.

As stated above, the accent feature acts to change the sound of the cymbal sounds produced by striking the drum 42 or by pressing the keys 23–25. The user may use the recording function of the synthesizer 10 to store a series of accent pulses by enabling the recording function and by pressing the key 38 (or the foot pedal) at the desired times. Pressing the key 38 by itself does not produce any sound but does cause the accent pulses to be recorded.

The user may then play back the recorded accent pulses. If the user then initiates a cymbal sound by, for example, striking the drum 42, and if that sound is initiated coincident with one of the accent pulses being played back, the cymbal sound generated will be changed to include the accent.

The construction of the drums 40–46 will now be described with reference to FIGS. 2 and 3. FIG. 2 is an exploded perspective view of the drum 40, and FIG. 3 is a cross-sectional view showing the drum 40 mounted to the housing 12. The drum 40 includes a piezoelectric ceramic disc 60 mounted within a hollow cylindrical enclosure comprising an upper section 62 and a lower section 64. A cylindrical cavity 66 is provided in the center of the lower section 64 to centrally locate the disc 60, and a cavity 68 is provided within the upper section 62 to support one end of a resilient spacer 70. Both the upper section 62 and the lower section 64 include four circumferentially spaced apart lugs 72 having openings therein. Conductors 74 are provided, one end of each of which is connected to one of the terminals of the ceramic disc 60. The conductors 74 are routed through the lower section 64 using a slot 76 provided therein. The upper section 62, containing the spacer 70, is assembled over the lower section 64, containing the disc 60. The section 62 is held to the lower section 64 by a rim 78 provided on the section 64 which tightly engages the inner wall of the section 62. The section 62 is oriented with respect to the section 64 so that the lugs 72 on the respective sections 62 and 64 are aligned. A hollow resilient grommet 80 is installed through the opening in each set of aligned lugs 72, and is retained therein by projecting flanges 81 which snap over each of the lugs 72. A thin pad of resilient material 82 is adhesively fastened to the outer surface of the upper section 62.

The resultant assembly of the drum 40 is shown in FIG. 3. When the upper section 62 and the lower section 64 are fastened together, it can be seen that the resilient spacer 70 extends between the inner wall of the section 62 and the surface of the ceramic disc 60. The spacer 70 is sized to apply a slight amount of pressure to the disc 60 which aides in holding it in place.

The pad 82 forms the striking surface of the drum 40. When the pad 82 is struck (for example, by hitting it with a drumstick) a portion of the striking force is transmitted through the spacer 70 to the disc 60. The disc 60 acts as a pressure transducer and generates an output voltage across the conductors 74 in a manner well known to those skilled in the art. This voltage has an amplitude proportional to the magnitude of the force striking the disc 60, and is used to produce the analog pulse referred to above.

The resilient spacer 70 in conjunction with the upper section 62 and the pad 82 acts to absorb a portion of the striking force to prevent damage to the ceramic disc 60 from the application of excessive force. The amount of force transmitted from the pad 82 to the disc 60 is to some extent a function of where on the pad 82 the force is applied. For example, hitting the pad 82 directly in the center will transmit a greater amount of force to the disc 60 then hitting the pad 82 in an area adjacent to its outer periphery. Accordingly, the amplitude of the output voltage produced by the disc 60 is a function both of the magnitude of the force striking the pad 82 and of the point at which the force is applied to the pad 82.

The drums 42, 44 and 46 shown in FIG. 1 are all constructed in a manner identical to construction of the drum 40. Because all four of the drums 40, 42, 44 and 46 are mounted to the single housing 12, it is important that each of the drums 40, 42, 44 and 46 be mechanically isolated from each other. This isolation is necessary to prevent the force striking one of the drums from being coupled to the other drums. Such cross-coupling can cause the other drums to produce unwanted output signal voltages which in turn causes the synthesizer 10 to generate unwanted musical beats.

FIG. 3 shows how the drum 40 is mounted to the housing 12 in a manner which mechanically isolates it to the extent necessary to prevent coupling to the other drums. The upper section 14 of the housing 12 includes an opening 84 through which the upper section 62 of the drum extends. Bosses 86 extend from the inner surface of the upper section 14. Hollow cylindrical projections 88 extend from the bosses 86 through the openings in the hollow grommets 80 mounted to the drum 40. The bottom end of the projection 88 contacts the upper end of a hollow boss 90 projecting from the inner surface of the lower section 16 of the housing 12. Self tapping screws 92 are used to fasten the hollow boss 90 to the hollow projection 88. These screws 92 serve both to hold together the upper and lower sections 14 and 16, and to retain the drum 40 within the housing 12. The length of the projection 88 is chosen so that the grommet 80 is compressed slightly between the bosses 86 and 90. The projections 88 act in combination with the grommets 80 to center the drum 40 within the opening 84.

From the above description, it can be seen that the only mechanical connection between the drum 40 and the housing 12 is through the four resilient grommets 80. The grommets 80 act to mechanically isolate the drum 40 from the housing 12 in a manner which prevents undesirable mechanical coupling to the housing 12 and to the other drums. The remaining three drums 42, 44 and 46 are mounted to the housing 12 in a manner identical to the mounting of the drum 40. In a preferred embodiment of the invention, the sections 14, 16, 62 and 64 are formed of ABS plastic, the grommets 80 are formed of neoprene, the spacer 70 is formed of neoprene foam, and the pad 82 is formed of vinyl. The disc 60 is approximately twenty seven millimeters in diameter and is preferrably a piezoceramic speaker element supplied by Shigoto Corp., New York.

FIG. 4 is an overall block diagram of the electronic portion of the percussion synthesizer 10 of the present invention. As is shown therein, the synthesizer 10 includes a central processor (CPU) 100 which receives input signals from the keyboard 18, from foot pedals 102, from a signal processor 104 and from a random access memory (RAM) 106. In response to these input signals, the central processor 100 provides output signals to the signal processor 104, to the random access memory 106, and to the LED indicators 48–56.

The central processor 100 is preferrably a microprocessor, such as a type number 6405 supplied by Sanyo Corporation. Such microprocessor circuits are well known and include all of the input, output, logic and control circuitry of a special purpose digital computer in miniature form. In general, such circuits includes a read only memory (ROM). The ROM memory has connections formed by masking operations during the construction of the basic circuitry of the digital computer itself to provide a completely wired circuit which includes the program for controlling the operation of the microprocessor.

The RAM memory 106 is preferrably a type 2114 supplied by National Semiconductor, and is utilized for storage of the various bits of information and program during the operation of the synthesizer 10.

The signal processor 104 receives input signals from each of the drums 40, 42, 44 and 46, and from the CPU 100. The signals from the drums 40–46 are those generated by the piezoelectric ceramic discs such as the disc 60 used in the drum 40. The signal processor 104 also communicates with wave shaping networks 108 and provides output signals to the input terminals of a stereo amplifier 110.

The signal processor 104 in conjunction with the waveshaping networks 108 serves to convert the signals from the drums 40, 42, 44 and 46 and from the processor 100 into waveforms representing the sounds of the various percussion instruments. The signal processor 104 also serves to convert the signals from the drums 40, 42, 44 and 46 into proper form for storage by the CPU 100.

The signal processor 104 is preferrably a custom integrated circuit including the necessary transistors, diodes and bias networks to perform the signal processing functions described in detail below. Such an integrated circuit may be formed, for example, using a mask configureable integrated circuit such as the Monochip, supplied by Interdesign Corp. This type of circuit may be configured, using suitable masking operations, to perform the necessary signal processing functions of the synthesizer 10. The tune control 112 is connected to the signal processor 112 and is used to adjust the tune of the first Tom-Tom drum over a five octave range.

The stereo amplifier 110 provides left and right channel output signals to connectors 114 and 116, respectively, in response to the signals provided by the processor 104. The volume control 58 controls the amplitude of these output signals, which are suitable for operating headphones or a stereophonic sound system.

A power supply 118 converts the voltage from a battery 120 into the proper voltages for powering the various circuits of the synthesizer 10.

Analog Signal Generation

Figure 5:
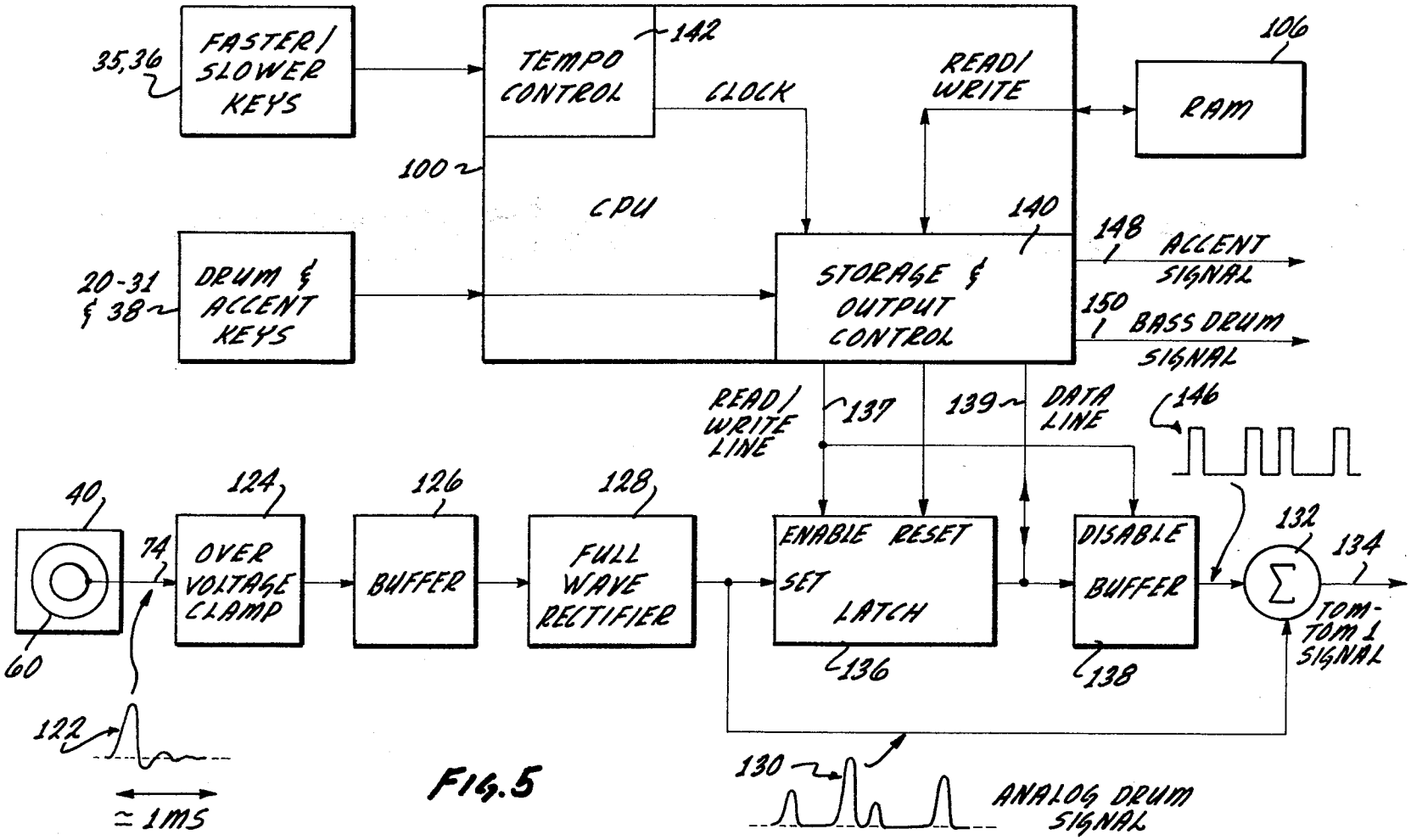
FIG. 5 is a block diagram showing the electrical interconnections between the drum of FIG. 2, and the signal processor and the central processing unit of the synthesizer of FIG. 1.

FIG. 5 is a block diagram showing the interconnections between the piezoelectric disc 60 of the drum 40, and the signal processor 104 and the CPU 100. The operation of the circuitry of FIG. 5 when the drum 40 is struck is as follows. Striking the drum 40 causes the disc 60 to generate a voltage having a waveform 122. This voltage is in the form of a pulse having a width of about one millisecond and having an amplitude proportional to the striking force, as described above. The plurality of the pulse may be positive or negative, depending on the distribution of the striking force relative to the surface of the ceramic disc 60.

The pulse generated by the disc 60 is provided by the conductors 74 to an overvoltage clamp 124 which is part of the processor 104. The clamp 124 serves to limit the maximum amplitude of the pulse, which may range up to several hundred volts, to a maximum level, such as ten volts, which may be safely applied to the circuits of the synthesizer 10 without causing circuit breakdown. The clamp 124 provides the clamped pulse to a buffer 126 which in turn provides the pulse to a full wave rectifier 128. The purpose of the rectifier 128 is to convert the pulse from the disc 60 to one in which the polarity is always positive.

The signal appearing at the output of the rectifier 128 is the analog drum signal referred to above. It consists of a series of analog drum pulses each of which represents one strike of the drum 40. Waveform 130 shows a typical waveform of the analog drum signal when the drum 40 is struck four times. The amplitude of each of the four analog drum pulses in the waveform is proportional to the respective striking force used to produce each pulse.

The analog drum signal from the rectifier 128 is applied to a summing junction 132, the output of which is connected to a line 134. The line 134 is in turn connected to portions of the processor 104 and waveshaping networks 108 (described below) which are used to generate a waveform representing one beat of the first Tom-Tom drum in response to each of the analog pulses appearing in the waveform 130.

The analog drum signal from the rectifier 128 is also provided to a set input terminal of a drum latch (or flip-flop) 136. An enable input terminal of the latch 136 is connected to receive a signal provided on a read/write line 137 from a storage and output control section 140 of the CPU 100. A reset input terminal of the latch 136 is also connected to receive a reset signal from the control section 140 of the CPU 100. An output terminal of the latch 136 is connected both to an input terminal of a buffer 138 and to a bi-directional data line 139 from the control section 140. An output terminal of the buffer 138 is connected to an input terminal of the summing junction 132. The read/write line 137 connected to the enable terminal of the latch 136 is also connected to a disable input terminal of the buffer 138. The function of the latch 136 and the buffer 138 are discussed in detail below.

The signal processor 104 includes a total of four circuits each equivalent to that portion of the circuit of FIG. 5 which includes the elements 60, 124, 126, 128, 132, 136, and 138. Each of these four circuits is used to process the signals from the respective transducers in each of the drums 40–46 in the manner described above for the transducer 60 in the drum 40. The latch 136 and buffer 138 portions of the four circuits are each connected to the storage and output control section 140 of the CPU 100 in the same manner as the latch 136 and buffer 138 shown in FIG. 5. Output signals from the summing junction portion of each of the four circuits are separately provided to portions of the processor 104 and waveshaping networks 108 to generate the waveforms representing the sounds of each of the four drums 40–46.

Rhythm Signal Generation

The operation of the circuitry of FIG. 5 when the keys 20–22 are pressed (representing rhythms of the first Tom-Tom drum) is as follows. The CPU 100 includes a tempo control section 142 responsive to the keys 35 and 36 for generating the clock pulses at the clock rate as described above. These clock pulses are provided to the storage and output control section 140 of the CPU 100 and are used to time the functions of this section.

The drum control keys 20–31 and the accent key 38 are connected to the control section 140 of the CPU 100. The status of each of these keys is read (or interrogated) by the control section 140 at the clock rate.

If any of the keys 20–31 are pressed (or closed) when they are interrogated, the control section 140 generates a respective rhythm signal.

Each rhythm signal consists of a series of pulses where each pulse is synchronized to the clock pulse and corresponds to the sound of a single beat of the respective percussive instrument. The rate at which these rhythm pulses are produced is dependent on which of the keys 20–31 have been pressed. For example, pressing the key 20 initiates a first Tom-Tom rhythm signal comprising a series of evenly spaced rhythm pulses at a rate corresponding to the slow rate of the first Tom-Tom drum; the key 21 initiates pulses at the medium rate; and the key 22 initiates pulses at the fast rate. Since the slow rate corresponds to two beats for each bass drum beat, the rhythm signal corresponding to the slow rate consists of one rhythm pulses every eighth clock pulse. In like manner, pressing simultaneously more than one of the keys 20–22 produces rhythm signal pulses corresponding to the respective "rock", "waltz", "off-beat" and "shuffle" rhythm patterns. These four predetermined rhythm patterns are stored in the ROM memory portion of the CPU 100, and are transferred to a portion of the RAM memory 106 during the operation of the synthesizer 10 to permit them to be accessed by the CPU 100.

The rhythm pulses of the first Tom-Tom drum are combined with the analog drum pulses produced by the drum 40 in the following manner. Referring to FIG. 5, the storage and output control 140 provides at each clock pulse a write signal on the line 137 which both disables the drum latch 136 and enables the buffer 138. At the same time, the output control 140 provides the rhythm signal to the input terminal of the buffer 138, using the data line 139. The buffer 138, in turn, provides the rhythm signal to the summing junction 132 where it is combined with the analog drum signal on the line 134. Waveform 146 shows a pattern of first Tom-Tom rhythm pulses generated by the CPU 100 in response to actuation of the keys 20–22.

The rhythm pulses are synchronized with the clock pulses and are all produced having a fixed amplitude. As in the instance of the analog drum pulses, each rhythm pulse is provided by line 134 to portions of the synthesizer circuitry which generate a waveform representing one beat of the first Tom-Tom drum in response to each of the pulses appearing in the waveform 146.

The above description of the generation of the first Tom-Tom rhythm signal applies to the generation of the rhythm signals corresponding to the cymbal, the snare drum, and the second Tom-Tom drum respectively.

The CPU 100 also provides an accent signal on the line 148 in the form of an accent pulse produced when the accent key 38 is interrogated and is found to be pressed. The CPU 100 also provides a bass drum signal on the line 150 in the form of a bass drum pulse generated at a rate of one bass drum pulse for every sixteen clock pulses.

Signal Recording and Playback

In addition to the generation of the analog drum and rhythm signals the circuitry shown in FIG. 5 performs the following functions when the synthesizer 10 is in the recording mode. When the recording function is initiated by depressing the keys 33, 23, 24, and 25 in the manner described above, the CPU 100 generates a digital drum pulse which is in essence a digitized version of the analog drum pulse.

Referring to FIG. 5 the signal appearing on the line 137 is normally set by the control 140 to a read level which enables the latch 136 to respond to signals appearing on the set input. Thus, when an analog drum pulse appears at the output terminal of the rectifier 128, this pulse acts to set the latch 136 to a first output voltage state. The same signal level on the line 137 which enables the latch 136 acts to disable the buffer 138. When the buffer 138 is disabled, no signals are furnished to its output terminal. Accordingly, when the latch 136 switches to the first output voltage state, the signal thus appearing at the output terminal of the latch 136 does not cause a corresponding signal to appear at the output terminal of the buffer 138.

As each clock pulse is generated by the tempo control 142, the control 140 reads (or interrogates) the output stage of the latch 136 by reading the voltage level appearing on the data line 139. After the latch 136 has been interrogated, it is reset to a second output voltage state. The signal appearing on the line 137 is then switched to a write level which disables the latch 136 and enables the buffer 138. This condition permits the control 140 to provide data on the line 139 which will be transferred by the buffer 138 to the summing junction 132.

Each time the latch 136 is found to be set to the first output state when it is interrogated, the control 140 generates a digital drum signal in the form of a fixed amplitude pulse. Each of these digital drum pulses corresponds to a respective one of the pulses of the analog drum signal, except that the digital drum pulses are automatically synchronized to the clock rate by the actions of the latch 136 and the control 140.

At each clock pulse, the control 140 acts both to generate the digital drum pulse in response to the output state of the latch 136, and to generate the rhythm pulse in response to the state of the respective keys 20–31 in the manner described above. If the control 140 has generated either a digital drum pulse or a rhythm pulse, the control 140 acts to generate one pulse of a beat signal and attempts to store that pulse in the RAM memory 106. The digital drum pulse and the rhythm pulse are combined by digitally ORing these pulses together at each clock pulse to form the beat pulse.

The memory locations of the RAM 106 are sequentially addressed in a recirculating loop at the clock rate. The control 140 will store the beat pulse in the memory location being addressed if that location does not already contain a beat pulse. This storage function is carried on each time the memory loop is repeated. It should be noted that while this storage function is being performed by the CPU 100, it continues to provide the rhythm signal to the line 134 by way of the line 139, the buffer 138 and the summing junction 132.

After the control 104 has completed the first loop through the appropriate locations of the RAM 106, it acts to combine the stored beat signal with the rhythm signal to form a composite beat signal comprising composite beat pulses representing the beat pulses previously stored plus the rhythm pulses presently being initiated by the user using the keys 20–31. Each time the control 140 loops through the memory it continues to store additional beat pulses. The stored beat pulses and rhythm pulses are combined by digitally ORing these pulses together at each clock pulse to form the composite pulse. The composite beat signal thus generated is provided to the summing junction 132 in place of the rhythm signal using the data line 139 and the buffer 138 described above in providing the rhythm signal. Accordingly, when the synthesizer 10 is performing the recording function, the waveform 146 represents the waveform of the composite beat signal.

The playback function of the synthesizer 10 is initiated by depressing the keys 34, 23, 24, and 25 in the manner described above. In the playback mode, the circuitry of FIG. 5 performs in a manner identical to that described for the record mode except that no additional beat pulses are stored in the RAM memory 106. Accordingly, the composite signal generated during playback represents the previously stored beat signal plus the rhythm signal presently being initiated by the user.

The above description represents the operations of the synthesizer 10 in recording and playing back the various signals representative of the sounds of a single percussion instrument such as the first Tom-Tom drum. The signals representative of the sounds of the cymbals, the snare drum and the second Tom-Tom drum are each recorded and played back simultaneously with and in the same manner as the first Tom-Tom drum. Separate memory locations are provided in the RAM 106 to simultaneously provide four memory loops, each used to store the beat signal of a respective one of the musical instruments.

Memory locations are also provided in the RAM 106 to form a memory loop for storing the accent signal. As described above, the accent signal is in the form of accent pulses generated in response to the actuation of the accent feature by pressing the key 38 or the foot pedal. The accent pulses thus produced are both provided on the line 148 and recorded in the appropriate memory locations. The recording of the accent pulses is analogous to the recording of the beat pulses described above. Thus, the accent pulse is only stored in the addressed location if there is no accent pulse already stored in that location. At the completion of the first loop through the accent memory locations, the accent signal appearing on the line 148 is a composite accent signal including both the stored accent pulses as well as the accent pulses presently being generated in response to the key 38 and the foot pedal.

It should be noted that there is no need to store the bass drum signal representating the bass drum beat, since the bass drum signal is simply comprised of one pulse for every sixteen clock pulses.

Percussion Waveform Generation

Figure 6:
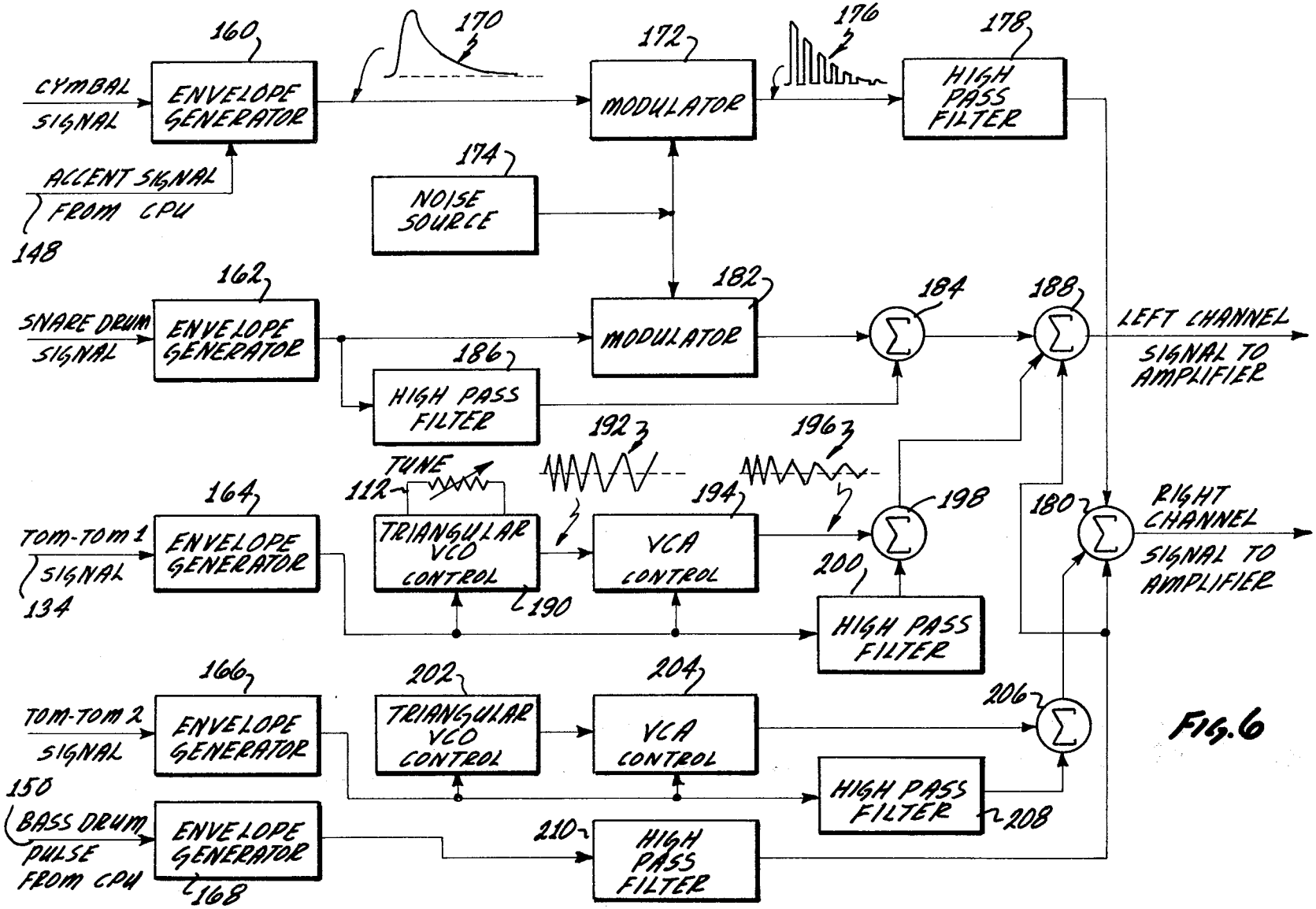
FIG. 6 is a block diagram of portions of the signal processor and wave shaping networks of the synthesizer of FIG. 1 used to generate the percussion waveforms.

FIG. 6 is a block diagram showing those portions of the signal processor 104 and the waveshaping networks 108 used to generate the various waveforms which simulate the sounds of the respective percussion instruments.

Referring to FIG. 5, the Tom-Tom 1 signal appearing on the line 134, the accent signal appearing on the line 148 and the bass drum signal appearing on the line 150 are all provided as input signals to respective portions of the signal processor 104 and waveshaping networks 108 shown in FIG. 6. In addition, a cymbal signal, a snare drum signal and a Tom-Tom 2 signal are provided as input signals to the circuitry of FIG. 6. As described above, the cymbal, snare drum and Tom-Tom 2 signals are each generated in the same manner as the Tom-Tom 1 signal appearing on the line 134 of FIG. 5.

The cymbal signal is provided to an input terminal of an envelope generator 160; the snare signal, to an input terminal of an envelope generator 162; the Tom Tom 1 signal, to an input terminal of an envelope generator 164; the Tom-Tom 2 signal, to an input terminal of an envelope generator 166; and the bass drum signal, to an input terminal of an envelope generator 168. The accent signal is provided to a control terminal of the generator 160.

The envelope generators 160–168 are each designed to generate an exponentially decaying waveform in response to the occurrence of each pulse appearing at their respective input terminals. Waveform 170 shows a typical waveform produced by the generator 160 in response to a pulse from the cymbal signal. Each exponential waveform represents the amplitude envelope of a single beat of the respective percussive instrument. The amplitude of each of the exponential waveforms thus produced is proportional to the amplitude of the pulse which initiated that waveform. The amplitude of the exponential waveform, in turn, determines the amplitude of the percussion beat sound generated by the synthesizer 10. The duration of the exponential waveform is controlled by the respective waveform generator and is independent of the duration of the pulse appearing at the generator input terminal.

Returning briefly to FIG. 5, it can be seen that the Tom-Tom 1 signal is composed of analog drum pulses from the analog drum signal (waveform 130) which vary in amplitude depending on how hard the drum 40 is struck. The Tom-Tom 1 signal is also composed of digital pulses generated by the CPU 100 and having fixed amplitudes. Accordingly, the waveform generator 164 in FIG. 6 will produce exponential waveforms in response to pulses from the analog drum signal which vary in amplitude in proportion to how hard the drum 40 is struck. The generator 164 will also produce exponential waveforms in response to the digital pulses produced by the CPU 100 which are all the same amplitude.

Returning to FIG. 6, the percussion waveform representing the beat of the cymbal is created as follows. The exponentially decaying waveform from the generator 160 is provided as an input signal to a first input terminal of a modulator 172. An output signal from a noise source 174 is provided to a second input terminal of the modulator 174. The modulator 174 acts to amplitude modulate the signal from the noise source 174 by the signal from the generator 160. The resultant modulated signal, having a waveform 176, is provided through a high pass filter 178 to an input terminal of a summing junction 180. The signal appearing at an output terminal of the junction 180 is provided as a right channel sound signal to one input terminal of the stereo amplifier 110 shown in FIG. 4.

The time constant of the waveform 170 is chosen so that the cymbal waveform creates a sound simulating the beat of a cymbal. The accent signal provided to the control terminal of the generator 160 acts to change the time constant of the waveform 170 to change the decay of the cymbal sounds thus produced. The time constant of the generator 160 is thus changed in response to each pulse of the accent signal.

The percussive waveform representing the beat of the snare drum is created as follows. The generator 162 produces an exponentially decaying waveform which is provided to a first input terminal of a modulator 182. The output signal from the noise source 174 is provided to a second input terminal of the modulator 182. The modulator 182 acts to amplitude modulate the signal from the noise source 174 by the signal from the generator 162. The resultant modulated signal is provided to a first terminal of a summing junction 184.

The signal from the generator 162 is also provided through a high pass filter 186 to a second input of the junction 184. The signal appearing at an output terminal of the junction 184 has a waveform which creates a sound simulating the beat of a snare drum, and is provided to an input terminal of a summing junction 188. The signal appearing at an output terminal of the junction 188 is provided as a left channel sound signal to a second input terminal of the stereo amplifier 110.

The percussive waveform representing the best of the first Tom-Tom drum is created as follows. The exponential waveform from the generator 164 is provided to a control terminal of a triangular voltage controlled oscillator (VCO) 190. The VCO 190 is designated to produce a triangular waveform 192 having a frequency proportional to the amplitude of the exponential waveform provided by the generator 164. The tone control 112 acts to adjust the frequency range of the VCO 190 which in turn adjusts the pitch of the first Tom-Tom drum over a five octave range.

The waveform 192 is provided to an input terminal of a voltage controlled amplifier (VCA) 194, and the exponential waveform from the generator 164 is provided to a control terminal of the VCA 194. The VCA 194 acts to vary the amplitude of the waveform 192 in proportion to the amplitude of the exponential waveform, resulting in waveform 196. The waveform 196 is provided to a first input terminal of a summing junction 198, and the exponential waveform from the generator 162 is provided through a high pass filter 200 to a second input terminal of the junction 198. The signal appearing at an output terminal of the junction 198 has a waveform which creates a sound simulating the beat of the first Tom-Tom drum and is provided to an input terminal of the summing junction 188.

The percussion waveform representing the beat of the second Tom-Tom drum is created in a manner similar to that of the first Tom-Tom drum. The exponential waveform from the generator 166 is provided to a respective control terminal of both a triangular VCA 202 and a VCA 204, the operations, of which are similar to the VCO 190 and the VCA 194 described above.

An output terminal of the VCO 202 is connected to an input terminal of the VCA 204, and an output terminal of the VCA 204 is connected to a first terminal of a summing junction 206. The exponential waveform from the generator 166 is provided through a high pass filter 208 to a second input terminal of the junction 206. The signal appearing at an output terminal of the junction 206 has a waveform which creates a sound simulating the beat of the second Tom-Tom drum and is provided to an input terminal of the summing junction 180.

The percussion waveform representing the beat of the bass drum is created as follows. The exponential waveform from the generator 168 is provided through a high pass filter 210 to an input terminal of both the summing junction 180 and the summing junction 188. The signal appearing at an output terminal of the filter 210 has a waveform which creates a sound simulating the beat of the bass drum.

From the above description of the generating of the various percussion waveforms, it can be seen that the waveforms representing the sounds of the first Tom-Tom drum and the Snare drum are provided to the left channel of the amplifier 110, the waveforms representing the sounds of the second Tom-Tom and the Cymbal are provided to the right channel of the amplifier 110, and the waveform representing the sound of the bass drum is provided to both the left and right channels of the amplifier 110. This particular configuration was chosen so that the direction of the sounds produced when the amplifier 110 is connected to a stereo sound system simulates the direction of the sounds produced by a conventional drum set.

FIGS. 7 through 10, which interconnect with each other at the places shown in the various figures, represent a flow chart diagram of a program for controlling the central processor 100 to effect the desired percussion synthesis in the preferred embodiment of the present invention.

Figure 7:
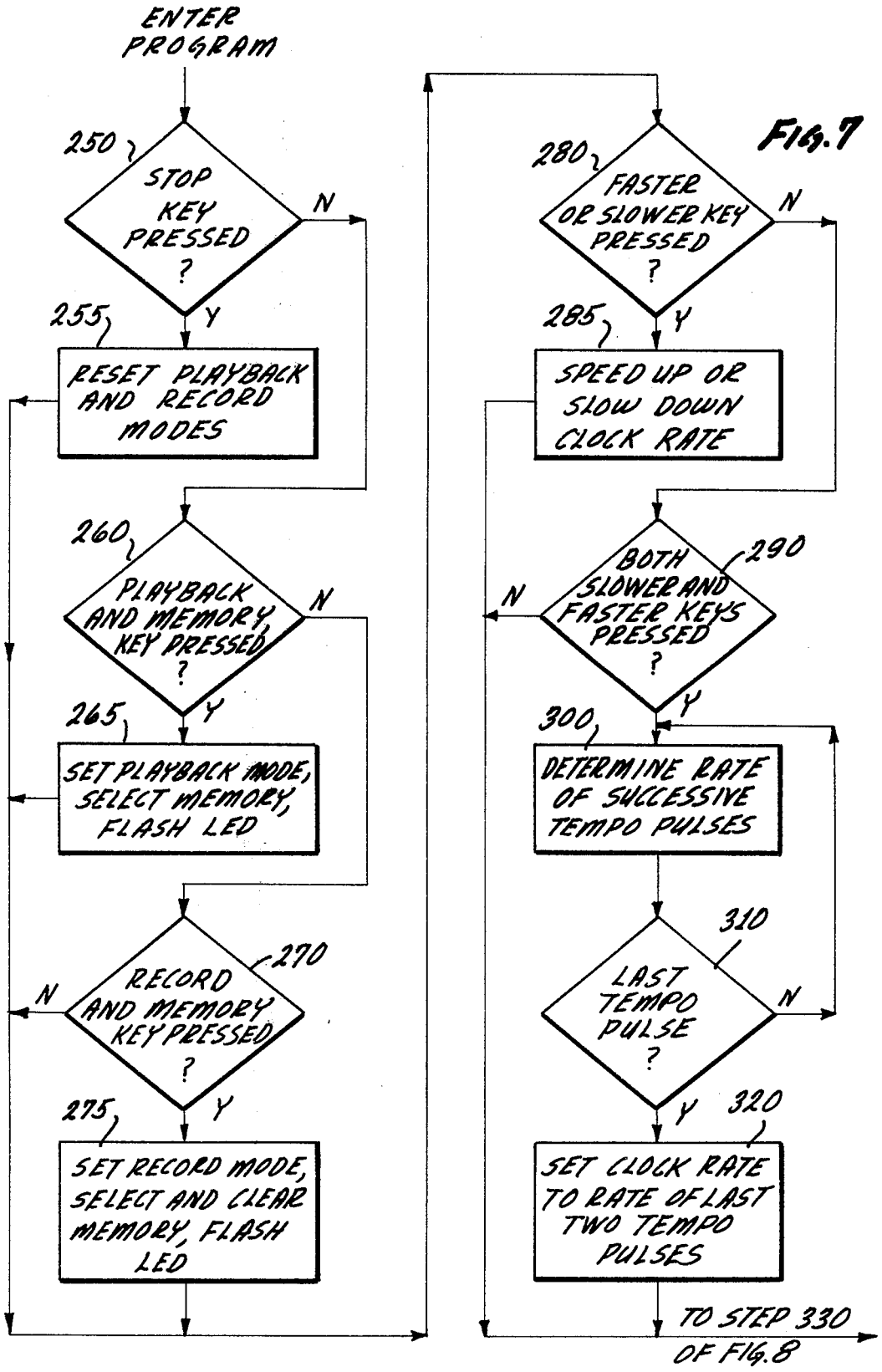

The program is entered at step 250 in FIG. 7 where it is determined whether the stop key 32 is pressed. If it has, the program moves at step 225 to turn off the playback and record modes and then moves to step 280. If at step 250 it is determined that the stop key has not been pressed, the program moves to step 260 to determine if the playback mode has been initiated by pressing the key 34 and one of the memory keys 23–25. If the playback mode has been initiated, the program moves at step 265 to set the playback mode, to select the appropriate memory and to flash the LED corresponding to that particular memory. The program then moves to step 280. If it is determined at step 260 that the playback mode has not been initiated, the program moves to step 270 to determine if the record mode has been initiated by pressing the key 33 and one of the memory keys 23–25. If the record mode has been initiated, the program moves at step 275 to set the record mode, to select and clear the appropriate memory and to flash the LED corresponding to that particular memory. The program then moves to step 280.

The program determines at step 280 if either the slower key 35 or the faster key 36 has been individually pressed. If either has been pressed, the program moves at step 280 to slow down or speed up, respectively, the clock rate. The program then moves to step 330 of FIG. 8. If, at step 280 is it determined that the keys 35 and 36 have not been individually pressed, the program moves at step 290 to determine if both keys 35 and 36 have been pressed simultaneously, indicating that the user wishes to enter a tempo. If such is the case, the program moves at step 300 to determine the rate of successive tempo pulses generated in response to the simultaneous actuation of the keys 35 and 36. As explained, above, the user may also enter these tempo pulses using a foot pedal.

The program then moves at step 310 to determine if the current tempo pulse is the last tempo pulse. The last tempo pulse is determined by waiting a prescribed interval of time, such as half a second, after the current tempo pulse has been entered. If no new tempo pulse is entered during this interval, it is assumed that the current tempo pulse is the last pulse entered. If such is the case, the program moves at step 320 to set the clock rate to the rate of occurrence of the last two tempo pulses. The program then moves to step 330 of FIG. 8. If, at step 310 it is determined that the current tempo pulse is not the last tempo pulse, the program returns to step 300 to determine the rate of the successive tempo pulses.

Figure 8:
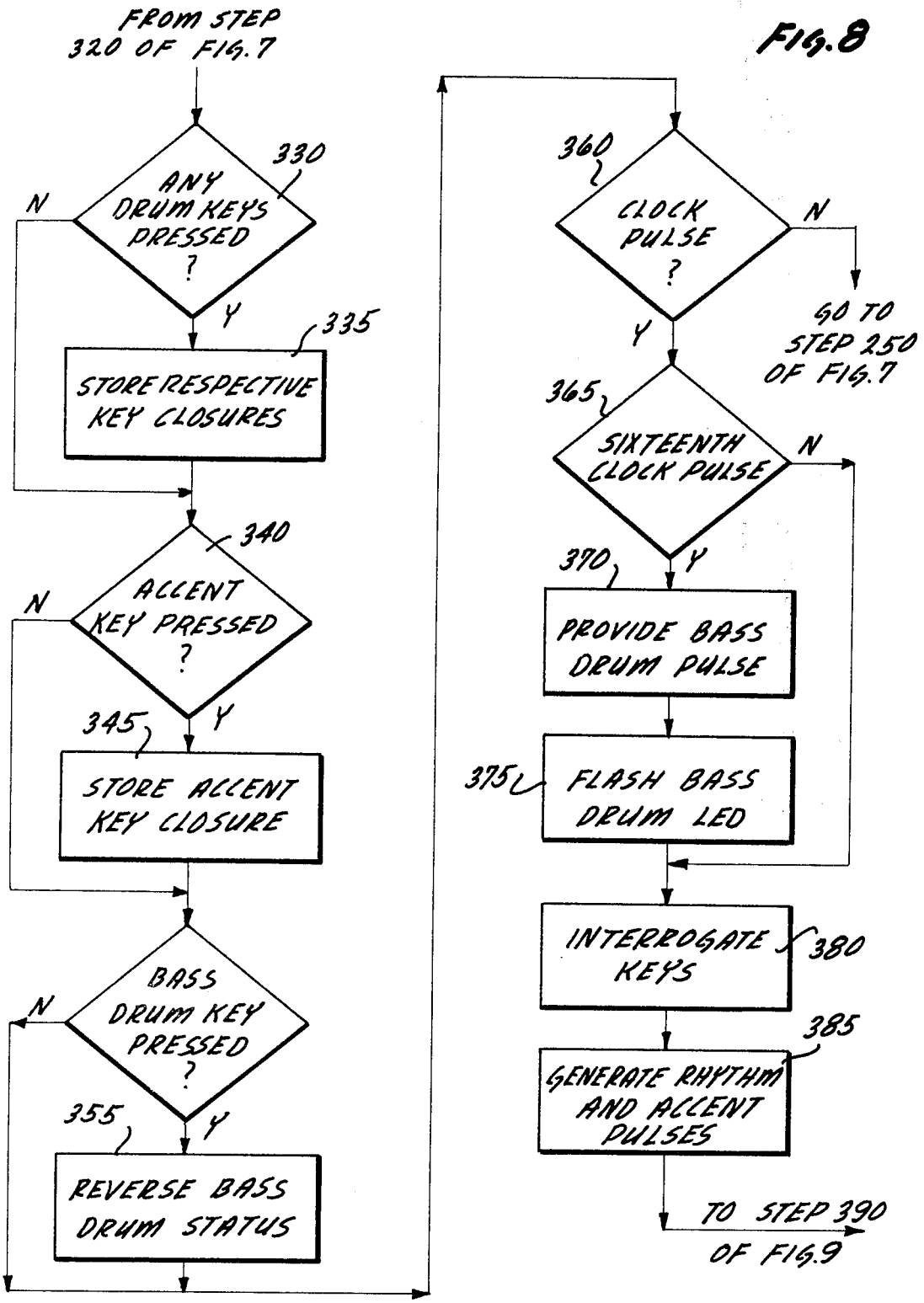

The program determines at step 330 of FIG. 8 whether any of the drum keys 20–31 have been pressed. If they have not, the program moves to step 340. If they have, the program moves at step 335 to store in memory event signals representing the respective key closures, and then moves to the step 340, where it is determined whether the accent key has been pressed.

If the key 38 (or the corresponding accent foot pedal) has been pressed, the program moves at step 345 to store in memory an event signal representing the closure of the accent key. The program moves from either the step 340 or the step 345 to step 350 where it is determined whether the bass drum key 37 has been pressed. If it has not, the program moves to step 360. If it has, the program moves at step 355 to reverse the bass drum mode. The key 37 acts as a toggle to alternately turn on and turn off the bass drum sound in response to sequential presses of the key 37. The program then moves to the step 360 to determine if a clock pulse has occurred. If it has not, the program returns to the start of the program at the step 250 of FIG. 7, and repeats the previous steps until it is determined at step 360 that a clock pulse has occurred.

When a clock pulse has occurred, the program moves from step 360 to step 365 to determine if this is the sixteenth clock pulse since the bass drum pulse was last generated. If it is, the program moves to steps 370 and 375 to provide a bass drum pulse and to flash the bass drum LED 56. The program moves from either the step 365 or the step 375 to step 380, where the keys 20–31 and 38 are interrogated. These keys are interrogated by polling the memory locations used to store the event signals at the steps 335 and 345 as described above.

The program moves at step 385 to generate the appropriate rhythm pulses and accent pulse in response to the state of the respective keys. The program then moves to step 390 of FIG. 9 where it is determined whether the record mode is set. It is recalled that the record mode is set by the step 275 of FIG. 7. If the record mode is not set, the program moves to step 460 of FIG. 10.

If the record mode is set, the program moves at step 395 to address the next memory location in those portions of the designated memory used to store the beat and accent pulses. The program then moves to interrogate and reset each of the four drum latches such as the first Tom-Tom drum latch 136 shown in FIG. 5. The program moves at step 405 to generate a digital drum pulse if the output state of the respective drum latch is set to the first output state. The program moves at step 410 to combine the respective digital drum pulse with the respective rhythm pulse to create the beat pulse for each of the four respective percussion instruments. As explained above, the beat pulse is created by digitally ORing together the digital drum and rhythm pulses. Thus, if either the digital drum pulse or the rhythm pulse (or both) are generated, a beat pulse is created.

The program moves at step 410 to determine if there is a beat pulse already in the addressed memory location. If there is, the program moves to step 425. If there is not, the program moves to step 420 to store the beat pulse (assuming one was generated) in the addressed memory location. The program then moves to step 425 to determine if there is an accent pulse already in the addressed accent memory location. If there is, the program moves to step 435 of FIG. 10. If there is not, the program moves at step 430 to store the accent pulse (assuming one was generated) in the addressed accent memory location and then moves to step 435 of FIG. 10.

The program determines at step 435 if one memory loop has been completed since the record mode has been set. If it has not, the program moves at step 440 to provide the rhythm and accent pulses to the percussive waveform generating circuits of FIG. 6, and then moves to step 480. If at step 435 it is determined that one memory loop has been completed, the program moves at step 445 to combine the stored beat pulses with the rhythm pulses to form the composite beat pulses. As explained above, this combination of signals is accomplished by digitally ORing together the stored beat pulses with the rhythm pulses. Thus, if either the stored beat pulse or the rhythm pulse (or both) and generated the composite beat pulse is produced.

The program then moves at step 450 to combine the accent pulse (assuming one was generated) with the stored accent pulse to form the composite accent pulse. The accent pulse is digitally ORed together with the stored accent pulse to form the composite accent pulse. The program moves at step 455 to provide the composite beat and composite accent pulses to the waveform generating circuits shown in FIG. 7, and then moves to step 480.

Returning to the step 390 of FIG. 9, if it was determined that the record mode was not set, the program moves to step 460 of FIG. 10 to determine if the playback mode has been set. It will be recalled that the playback mode is set at the step 265 of FIG. 7. If the playback mode has not been set, the program moves to the step 480. If the playback mode has been set, the program moves at step 465 to address the next memory location and to combine the stored beat pulses with the rhythm pulses in a digital OR fashion to form the composite beat pulses. The program then moves at step 470 to combine the accent pulse with the stored accent pulse in a digital OR fashion to form the composite accent pulse. The program moves at step 475 to provide the composite beat and composite accent pulses to the waveform generating circuits of FIG. 6, and then moves to the step 480.

The program at the step 480 acts to flash the appropriate drum LEDs 48–58 in response to the respective beat sounds produced. The program then moves at step 485 to determine if the memory location being addressed is the first location of the memory loop. If it is, the program moves at step 490 to flash all of the LEDs 48–56. The program moves from either the step 485 or the step 490 to the beginning of the program at the step 250 of FIG. 7.

While the invention is thus disclosed, and the presently preferred embodiment described in detail, it is not intended that the invention be limited to the shown embodiment. Instead, many modifications will occur to those skilled in the art which lie within the spirit and scope of the invention. It is accordingly intended that the invention be limited only by the appended claims.

What is claimed is:

1. An electronic music synthesizer comprising:

input means including means for generating an analog signal in the form of analog pulses, each representing one beat of a musical instrument;

latch means responsive to the input means for latching into a first state in response to the occurrence of each analog pulse unless the latch means is already in the first state in response to a previous analog pulse;

digital storage means including memory means having sequentially addressable memory locations;

tempo control means for establishing a continuous tempo rate at which the memory locations are addressed, where the tempo rate represents the desired tempo of the synthesized music;

computer means responsive to the tempo control means and the latch means and including means for interrogating the latch means at the tempo rate established by the tempo control means, means for sequentially addressing the memory locations in a recirculating loop at the tempo rate established by the tempo control means, means for generating a digital pulse if the latch means is in the first state when the latch is interrogated, means for storing the generated digital pulse in the addressed memory location if that location does not already contain the digital pulse, and means for resetting the latch means into a second state after it is interrogated; and sound signal generating means responsive to the input means and the computer means for generating a sound signal comprising the beat of the musical instrument if the analog pulse is generated or if the memory location addressed contains the digital pulse.

2. The synthesizer of claim 1 in which the input means includes pressure transducer means responsive to an external striking force for generating the analog pulse.

3. The synthesizer of claim 2 in which the amplitude of the analog pulse is proportional to the magnitude of the force, and in which the sound signal generated by the sound generating means in response to the input means has an amplitude proportional to the amplitude of the analog pulse.

4. The synthesizer of claim 1 in which the tempo control means for establishing a continuous rate includes:

tempo input means for providing a tempo pulse each time the tempo input means is actuated;

timing means responsive to the tempo input means for determining the frequency of occurrence of at least two successive tempo pulses; and rate means responsive to the timing means for setting and holding the rate equal to the frequency of occurrence of a particular pair of successive tempo pulses.

5. An electronic music synthesizer comprising:

input means including means for selecting a rhythm pattern representing the rhythm pattern of a musical instrument;

digital storage means including memory means having sequentially addressable memory locations;

tempo control means for establishing a continuous rate at which the memory locations are addressed including tempo input means for providing a tempo pulse each time the tempo input means is actuated;

timing means responsive to the tempo unit means for determining the frequency of occurrence of at least two successive tempo pulses, and rate means responsive to the timing means for setting and holding the rate equal to the frequency of occurrence of a particular pair of successive tempo pulses;

computer means responsive to the tempo control means and the input means and including means for interrogating the input means at the rate established by the tempo control means, means for sequentially addressing the memory locations in a recirculating loop at the rate established by the tempo control means, means for generating a rhythm signal comprising rhythm pulses if a rhythm pattern has been selected when the input means is interrogated, the determination of when each rhythm pulse is generated being a function of the selected rhythm pattern, and means for storing the generated rhythm pulse in the addressed memory location if that location does not already contain the rhythm pulse; and sound signal generating means responsive to the computer means for generating a sound signal comprising the beat of the musical instrument if the rhythm pulse is generated or if the memory location addressed contains the rhythm pulse.

6. The synthesizer of claims 4 or 5 in which the timing means includes means for determining the last two tempo pulses provided by the tempo input means, and in which the particular pair of tempo pulses includes these last two tempo pulses.

7. The synthesizer of claims 4 or 5 in which:

the digital storage means includes multiple memory means, each having sequentially addressable memory locations; and the means for sequentially addressing each of the memory locations including selection means for selecting which of the multiple memory means is to be addressed.

8. The synthesizer of claim 1 or 5 in which the input means further includes means for entering a second input signal representing an accent of the beat of the musical instrument;

second latch means are provided, responsive to the second input means for latching into the first state in response to the occurrence of the second input signal;

the digital storage means includes second memory means having sequentially addressable second memory locations;

the computer means is further responsive to the second latch means and further includes means for interrogating the second latch means at the rate established by the tempo control means, means for sequentially addressing the second memory locations in a recirculating loop at the rate established by the tempo control means, means for generating an accent pulse if the second latch means is in the first state when the second latch is interrogated, means for storing the accent pulse in the addressed second memory location if that location does not already contain the accent pulse, and means for resetting the second latch means into the second state after it is interrogated; and the sound signal generating means includes means for altering the decay of the generated sound signal if the accent pulse is generated or if the addressed second memory location contains the accent pulse.

9. An electronic music synthesizer comprising:

first input means for producing a first signal representing musical tones;

second input means for providing at least two tempo pulses spaced-apart in time where the pulses represent a desired tempo;

timing means responsive to the second input means for determining the frequency of occurrence of at least two successive tempo pulses;

indicator means for indicating a particular pair of successive tempo pulses;

storage means responsive to the timing means for storing the determined frequency of occurrence of successive tempo pulses;

tempo signal generating means responsive to the storage means for generating a continuous tempo signal having a frequency equal to the stored frequency; and sound signal generating means responsive to the first input means and the tempo signal generating means for generating a sound signal from the first signal and the tempo signal.

10. The music synthesizer of claim 9 further including interval means for establishing a predetermined interval of time, and in which the indicator means is further responsive to the interval means for indicating the particular pair of successive tempo pulses as that pair of successive tempo pulses which is not followed by a subsequent tempo pulse within the predetermined interval of time.

11. An electronic music synthesizer comprising:

input means for producing a plurality of sequential tone signals;

storage means responsive to the input means for storing each tone signal as it is produced if the storage means does not already contain a previously stored tone signal;

recording means for recording signals;

means for establishing a tempo rate which represents the desired tempo of the synthesized music;

tempo means for establishing tempo pulses at the tempo rate;

synchronizing means responsive to the storage means and the tempo means for transferring the stored tone signal from the storage means to the recording means at the occurrence of each tempo pulse, to produce a recorded signal, where each such transfer erases the contents of the storage means;

playback means responsive to the recording means for playing back the recorded signal; and sound signal generating means responsive to the playback means for generating a sound signal from the recorded signal.

* * * * *